US005086739A

United States Patent [19]

Fränkle

[11] Patent Number: 5,086,739

[45] Date of Patent: Feb. 11, 1992

[54] ELECTRONIC SPEED GOVERNOR FOR AN AIR-COMPRESSION INTERNAL-COMBUSTION ENGINE

[75] Inventor: Gerhard Fränkle, Remshalden, Fed. Rep. of Germany

[73] Assignee: Daimler-Benz AG, Fed. Rep. of Germany

[21] Appl. No.: 505,691

[22] Filed: Apr. 6, 1990

[30] Foreign Application Priority Data

Apr. 6, 1989 [DE] Fed. Rep. of Germany 39111458

[51] Int. Cl.[5] ..... F02M 37/00

[52] U.S. Cl. ..... 123/357; 123/380

[58] Field of Search ..... 123/357, 358, 359, 380

[56] References Cited

U.S. PATENT DOCUMENTS 3,924,594 12/1975 Aoki ..... 123/380
3,960,127 6/1976 Vuaille ..... 123/380
4,085,724 4/1978 Djordjevic ..... 123/380
4,227,504 10/1980 Ritter ..... 123/380
4,368,705 1/1983 Stevenson ..... 123/357
4,562,810 1/1986 Miyaki ..... 123/380
4,624,230 11/1986 Grieshaber et al. .

OTHER PUBLICATIONS

Automobil-Industrie 5/86—Elektronische Dieselregelung EDR für Nutzfahrzeugmotoren-pp. 653-659.

*Primary Examiner*—Carl Stuart Miller
*Attorney, Agent, or Firm*—Evenson, Wands, Edwards, Lenahan & McKeown

[57] ABSTRACT

An electronic speed governor for an air-compression internal-combustion engine that has an electronic control unit which detects numerous operating values of the automobile. The speed governor forms a control signal from these operating values as well as from stored limit values, and shifts smoke-limit curves as a function of altitude so that the fuel mass is corrected in accordance with keeping the smoke emissions constant.

3 Claims, 2 Drawing Sheets

ELECTRONIC SPEED GOVERNOR FOR AN AIR-COMPRESSION INTERNAL-COMBUSTION ENGINE

BACKGROUND AND SUMMARY OF THE INVENTION

The present invention relates to an electronic speed governor for an air-compression internal-combustion engine, and more specifically, to an electronic speed governor that has means for sensing operating values of the engine and means for measuring an absolute pressure to determine air mass for the engine.

Electronic diesel control (see Automobil-Industrie (Automobile Industry) 5/86 "Elektronische Dieselregelung" (Electronic Diesel Control"), page 653 ff.) ensures an accurate presetting of the fuel-injection quantity for any driving performance required by the driver. The electronic diesel control allows for environmental criteria and the criteria for permissible operating ranges of the internal-combustion engine. In the described control system, system sensors provide to an electronic control unit signals relating to the control-rod travel, the injection-pump speed, the position of the accelerator pedal, the charge-air and fuel temperature and the supercharging pressure. A correcting variable formed from these signals serves as a measure for determining values for the permissible injection masses, these values then being stored in a data module.

Depending on the speed of the internal-combustion engine and the correcting variable, either the exhaust-gas temperature or the blackening value (smoke) or the peak pressure is a limiting variable. Limiting areas, such as the smoke-limit, are identified in the family of full-load quantity characteristics (FIG. 13 of the above-mentioned publication). By close adherence to the predetermined smoke-limit curves, smoke emissions are reduced compared to those of conventional internal combustion engines that do not have smoke-limiting measures. However, because the smoke-limit is restricted to permissible values, desirable driving performance is not obtained at high altitude.

An objective of the present invention is to provide an electronic speed governor that allows the power capacity of the internal-combustion engine to be utilized as effectively as possible, even at high altitudes.

This and other objects are met by the present invention which provides an electronic speed governor for an aircompression internal-combustion engine that has means for sensing operating values of the internal-combustion engine and means for measuring an absolute pressure to determine air mass for the internal-combustion engine. A control unit has stored smokelimit curves, and is coupled to the means for sensing and the means for measuring. The control unit receives as inputs the operating values and the determined air mass and controls the fuel mass as a function of the operating values, the air mass and the stored smoke-limit curves. The control unit shifts the smoke-limit curves such that the smoke emission of the internalcombustion engine remains constant in response to decreasing atmospheric pressure. The control unit will correct a fuel mass according to the shifted smoke-limit curve.

Because the smoke-limit curve is raised as a function of the altitude at which the engine is operating, without entering the range of impermissible smoke emission, the best possible utilization of the power capacity of the internal-combustion engine can be obtained for a particular operating state. Thus, the blackening value that would be otherwise reduced in the conventional manner at high altitude by the electronic system is maintained at permissible values.

The lowered blackening value or the visible blackening at high altitude in relation to the same excess air for combustion arises because, in measurement terms, the same exhaust-gas volume is detected for determining the visibility of the blackening and is evaluated in respect of the particles. In relation to the evaluated volume, therefore, the tested exhaust-gas mass or its particle content is smaller than at sea level, because the air density becomes lower with increasing altitude. In the electronic control, the fuel mass and the air mass are interrelated for the same smoke.

Other objects, advantages and novel features of the present invention will become apparent from the following detailed description of the invention when considered in conjunction with the accompanying drawings.

DETAILED DESCRIPTION OF THE DRAWINGS

In an electronic speed governor for air-compression autoignition internal-combustion engine, the injected fuel mass is predetermined specifically in relation to the engine speed as a function of the particular air mass. The present invention uses electronics for controlling the internal-combustion engines of this type and varies the smoke-limit curve as a function of altitude in conformity with a constant smoke emission so as to correct the fuel mass. This provides the best possible effect in terms of fuel consumption and power.

The present invention uses a barometric altitude cell that is a signal generator. The signals from the altitude cell are provided to the electronic control unit of the engine for shifting of the smoke-limit curve.

Figure 1:
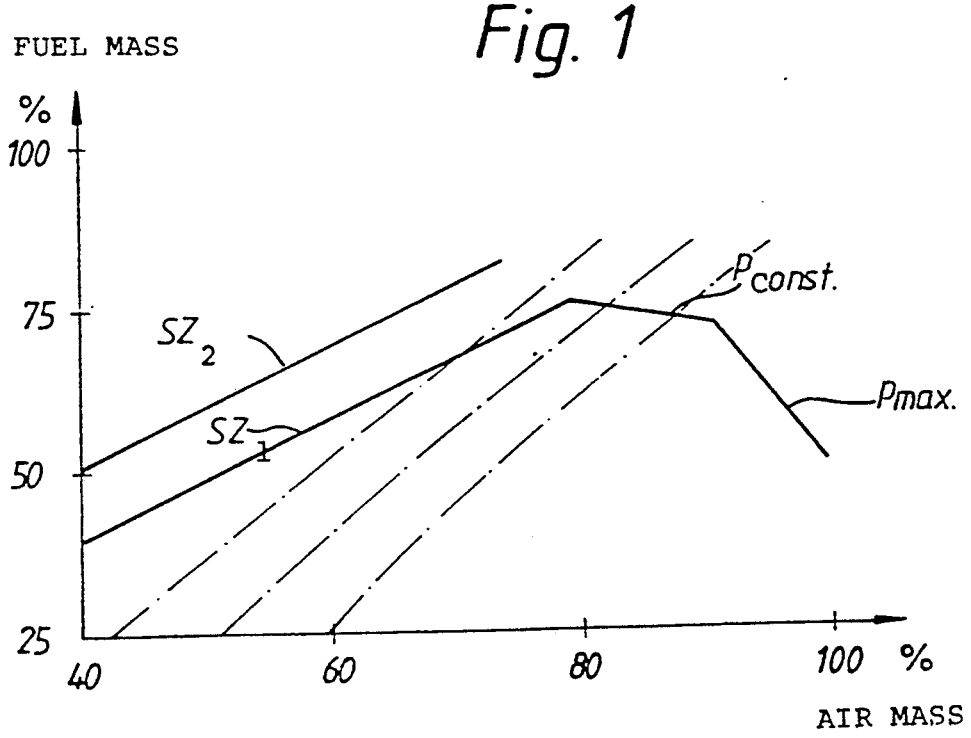
FIG. 1 shows a graph plotting smoke-limit curves in relation to fuel mass and air mass.

Assume that the visible blackening (visible soot-content) has, for example, the blackening value of 3.0 at sea level. This visible blackening decreases as a result of the air density becoming lower with increasing altitude. For the same exhaustgas volume, at approximately 2000 m above sea level, the visible blackening will have a value of approximately 2.5. However, the smoke-limit can always be shifted as a function of altitude such that the same blackening value of approximately 3.0 is obtained. For example, in the graph shown in FIG. 1, the smoke-limit curve is raised as a function of the fuel mass and air mass from a first permissible blackening value $=SZ_1$ to a second permissible blackening value $=SZ_2$ corresponding to a specific increase in altitude.

To ascertain the air mass contained in the internal-combustion engine, an absolute-pressure meter that is normally present in an air compression internal-combustion engine is first used to determine the barometer reading for the shift of the smoke-limit curve. In determining the barometer reading, a pressure trend can be stored over a relatively long period of time, for example 10 to 15 minutes, by repeatedly detecting the absolute ambient pressure from throttling back, unavoidable during motoring, which occurs as a result of gear changes or other circumstances. With a minimum-value read-out, the lowest pressure during a particular fifteen minute period can be used as a measure for shifting of the smoke-limit curve.

Figure 2:
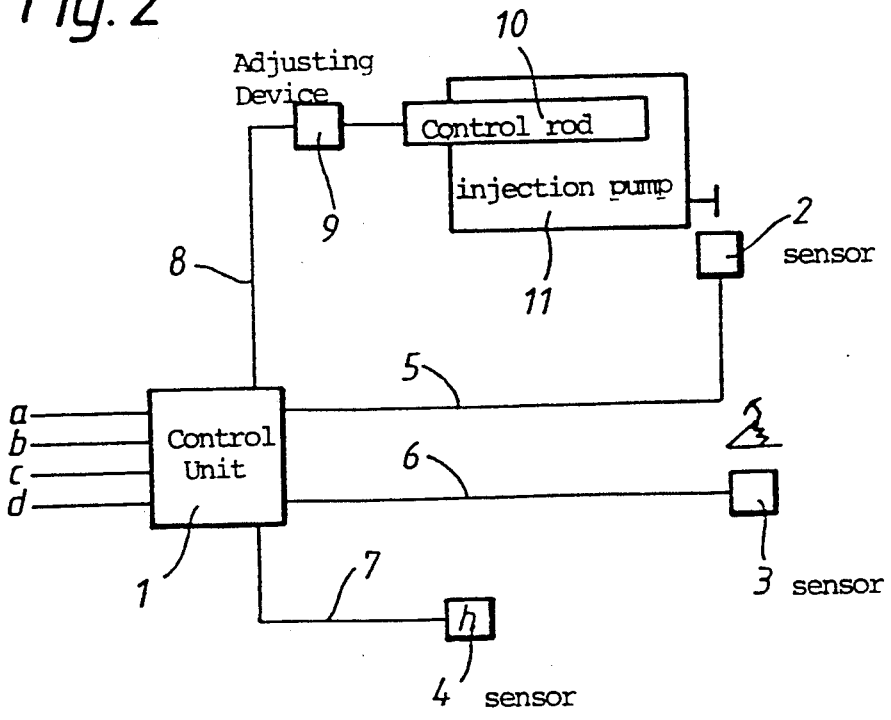
FIG. 2 is a block diagram of an electronic control unit that can be used with the present invention.

A block diagram of a control unit that can be used with the present invention is shown in FIG. 2. This control unit 1, via corresponding measured-value lines, receives from a sensor 2 a signal which corresponds to the actual rotational speed of the internal-combustion engine (not shown). From a sensor 3, the control unit 1 receives a load signal corresponding to the actual driving pedal position. From a sensor 4, the control unit receives a signal corresponding to the actual altitude pressure. The sensor 4 can be a barometric altitude cell used as a signal generator. Additional operating data of the internal-combustion engine are provided as inputs to the control unit 1, such as the charge air temperature a, the charge air pressure b, the driving speed c, and the absolute pressure d. As a function of the supplied signals, the control unit 1 generates an adjusting-value signal which, via a control line 8, controls an adjusting device 9 which, in turn, adjusts a control rod 10 of an injection pump 11.

Figure 3:
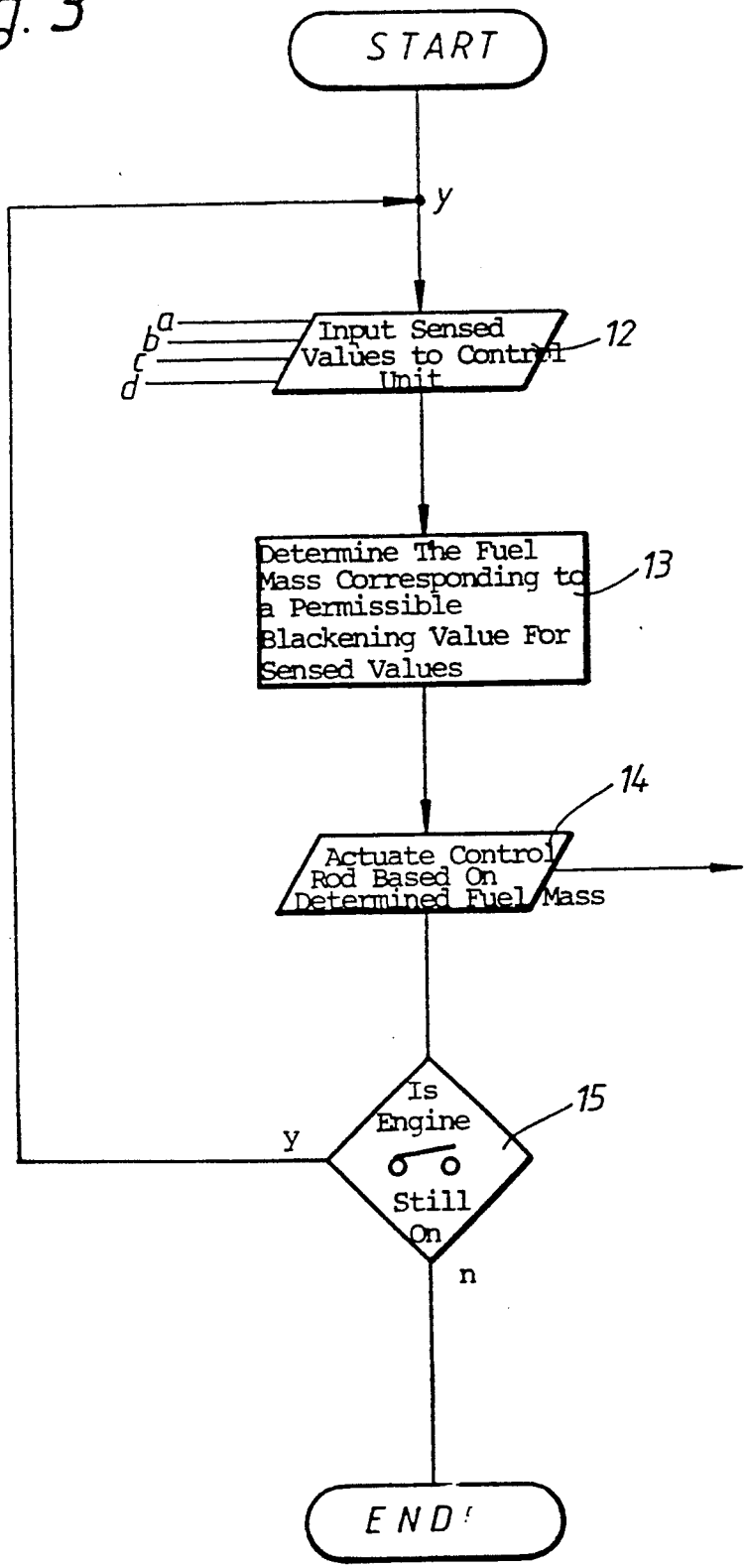
FIG. 3 is a flow chart illustrating the method of the present invention.

FIG. 3 shows a flow chart of the method of operation of the present invention. The control is actuated with the start of the internal-combustion engine. In input block 12, the data currently detected by all sensors are fed as input values to the electronic control unit 1 (FIG. 2). In block 13, the fuel mass which corresponds to the permissible blackening value of, for example, 3.0 is determined as a function of these previously detected values.

Based on the fuel mass value determined in block 13, the adjusting device 9 is controlled in block 14, thereby actuating the control rod 10 of the injection pump 11.

In block 15, the position of the ignition lock is checked to see if the engine is still on. If it has been switched off (n), the operation is ended. If the engine has not been switched off yet (y), then a branch occurs back to input block 12 so that new input values can be provided to the control unit 1.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An electronic speed governor for an air-compression internal-combustion engine, comprising:

means for sensing operating values of the internal-combustion engine;

means for measuring an absolute pressure to determine air mass for the internal-combustion engine;

a control unit having stored smoke-limit curves, said smoke-limit curves graphically providing engine operating parameters which produce a blackening value of the smoke emission, and, said control unit being coupled to the means for sensing and the means for measuring, and receiving as inputs the operating values and the determined air mass and controlling a fuel mass as a function of the operating values, the air mass and the stored smoke-limit curves, said control unit using shifted smoke-limit curves in response to decreasing atmospheric pressure so that the blackening value of the smoke emission per unit volume of the internal-combustion engine remains constant, and correcting a fuel mass according to the shifted smoke-limit curves.

2. The speed governor of claim 1, further comprising a barometric altitude cell coupled to the control unit, said barometric altitude cell operating as a signal generator of the atmospheric pressure to the control unit for shifting of the smoke-limit curves.

3. The speed governor of claim 1, wherein the control unit includes means for storing measured pressures over a specific period of time, and means for selecting a minimum value of these measured pressures for the specific period of time, this selected minimum value pressure being used by the control unit as a measure for the shifting of the smoke-limit curve.

* * * * *